US006196217B1

(12) United States Patent
Smith

(10) Patent No.: US 6,196,217 B1
(45) Date of Patent: Mar. 6, 2001

(54) BAT WARMER

(76) Inventor: Joseph D. Smith, 4717 42nd Ave., Sacramento, CA (US) 95824

( * ) Notice: Subject to any disclaimer, the term of this patent is extended or adjusted under 35 U.S.C. 154(b) by 0 days.

(21) Appl. No.: 09/444,863

(22) Filed: Nov. 22, 1999

(51) Int. Cl.[7] ..... F24J 2/02
(52) U.S. Cl. ..... 126/681; 206/315.1; 248/688
(58) Field of Search ..... 126/680, 681, 126/608; 206/315.1; 248/688; 473/564

(56) References Cited

U.S. PATENT DOCUMENTS 3,025,851 * 3/1962 Steinberg ..... 126/680
4,098,019 * 7/1978 Strong ..... 126/681
4,442,828 * 4/1984 Takeuchi et al. ..... 126/681
4,848,320 * 7/1989 Burns et al. ..... 126/680
4,890,731 * 1/1990 Mroz ..... 206/315.1
5,224,602 * 7/1993 Bettkes et al. ..... 206/315.1
5,284,332 * 2/1994 DiTullio ..... 473/564

FOREIGN PATENT DOCUMENTS

3029635 * 3/1982 (DE) ..... 126/608

* cited by examiner

*Primary Examiner*—Ira S. Lazarus
*Assistant Examiner*—Sara Clarke
(74) *Attorney, Agent, or Firm*—Patent & Trademark Services; Joseph H. McGlynn

(57) ABSTRACT

A solar powered bat warmer having a container which has openings for receiving at least one baseball bat. The container has an open side which is covered with plexiglass to accumulate solar rays and the back of the container has a support to angle the plexiglass to receive the sun's rays.

7 Claims, 1 Drawing Sheet

BAT WARMER

BACKGROUND OF THE INVENTION

This invention relates, in general, to a bat container, and, in particular, to a bat container which warms the bats by means of solar heat

DESCRIPTION OF THE PRIOR ART

In the prior art various types of warmer containers have been proposed. For example, U.S. Pat. No. 4,107,509 to Scher et al discloses a moisture resistant heating pad for treating arms or legs.

U.S. Pat. No. 4,736,088 to Bart discloses a heating pad which concentrates the flow of heat in one direction.

U.S. Pat. No. 5,687,705 to Blair discloses a bat warmer which has a convective thermal heat source positioned below the hanger for the bat.

U.S. Pat. No. 5,786,574 to Garnett discloses a bat warmer comprising a pouch with a battery operated heater attached to the side.

SUMMARY OF THE INVENTION

The present invention is directed to a solar powered bat warmer having a container which has openings for receiving at least one baseball bat. The container has an open side which is covered with plexiglass to accumulate solar rays and the back of the container has a support to angle the plexiglass to receive the sun's rays.

It is an object of the present invention to provide a new and improved bat warmer.

It is an object of the present invention to provide a new and improved bat warmer which operates without electricity.

It is an object of the present invention to providea new and improved bat warmer which is inexpensive and easy to assemble.

These and other objects and advantages of the present invention will be fully apparent from the following description, when taken in connection with the annexed drawings.

DESCRIPTION OF THE PREFERRED EMBODIMENT

Figure 1:
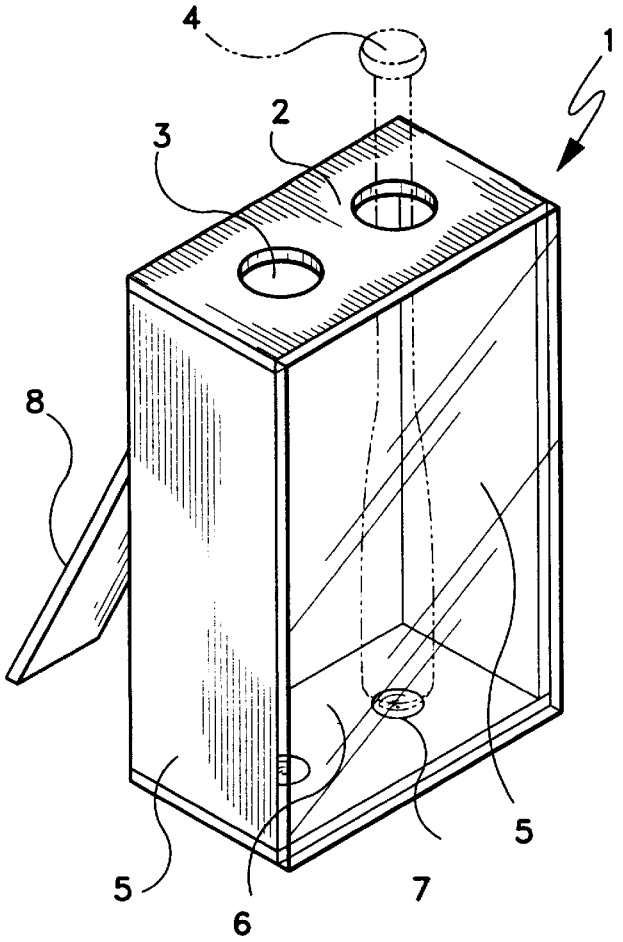
FIG. 1 is perspective view of the present invention.

Referring now to the drawings in greater detail, FIG. 1 shows a perspective view of the bat warmer 1 of the present invention. The bat warmer is designed to warm bats which will be used in cooler weather to prevent the bats from "denting" when they hit a ball. Since present day bats are very expensive, the bat warmer of the present invention will allow the bats to last longer.

The bat warmer, as shown in FIG. 1, comprises a container having a top 2 sides 5, a back 13 and a plexiglass front 6. The top 2 of the container has a plurality of apertures 3 which pass through the top 2 and allow bats 4 to be inserted inside the container through the apertures 3. The apertures 3 should be large enough to allow the head of the bat to pass through the apertures 3. The bottom of the container will have depressions 7 to receive the top of the bat.

Figure 2:
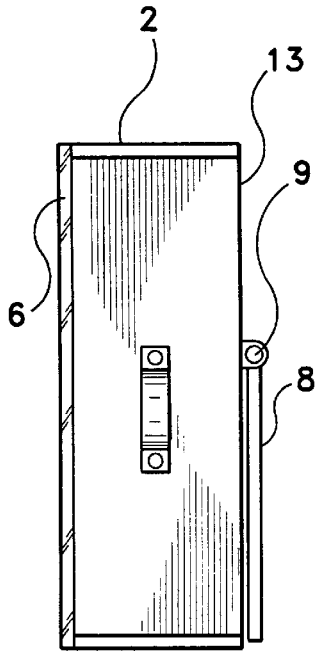
FIG. 2 is a side view of the present invention.
Figure 3:
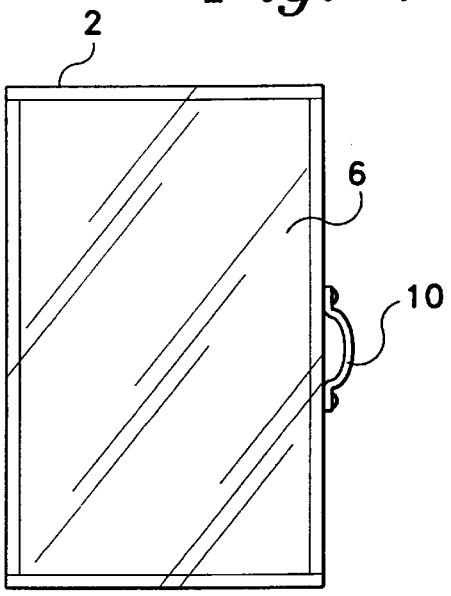
FIG. 3 is a front view of the present invention.
Figure 4:
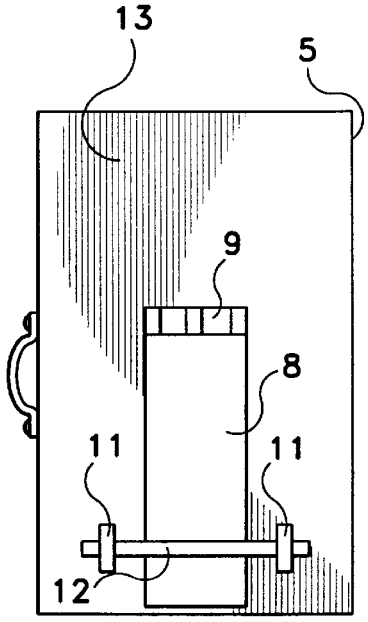
FIG. 4 is a back view of the present invention.

As shown in FIGS. 1, 2 and 4 the back of the container 1 has a pivoted brace 8 which will allow the container to stand up so the front of the containers can be pointed toward the sun. The brace 8 is pivoted to the back 13 by a conventional hinge 9, which allows the brace to be pivoted out away from the back, as shown in FIG. 1, to its in use position. The hinge also allows the brace 8 to be pivoted against the back 13 as shown in FIGS. 1 and 3, so the brace will make a compact design for transportation or storage.

In order to hold the brace in the stored position, a catch is provided on the back 13 of the container. The catch comprises a pair of supports 11 which have apertures to receive a removable rod 12. In order to store the brace 8 against the back 13 of the container, the rod 12 is removed from the supports 11. Next the brace 8 is pivoted against the back 13, and the rod is passed through the apertures in the supports 11 to hold the brace 8 in the stored position.

At least one of the sides 5 is provided with a handle 10, as shown in FIG. 3 so the bat warmer 1 can be easily transported. The handle can be any conventional type of handle and can be attached to the side 2 in any conventional manner.

In order to sue the bat warmer of the present invention, a user would first orient the front of the containers, which is made from plexiglass, toward the sun. The plexiglass can be attached to the container in any conventional manner. The brace 8 would then be released from the catch 11, 12 and pivoted out to support the container 1 in the proper position. Next, he/she would place bats 4 through the apertures 3 until the head of the bats rests in the depressions 7. It should be noted that only two apertures 3 are shown for receiving the bats 4, however, any number of apertures could be provided in the top 2 of the container with departing from the scope of the invention.

Solar rays would enter through the plexiglass front 6 and heat up the interior of the container, which would, in turn, warm the bats 4 placed in the container.

Although the Bat Warmer and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A bat warmer comprising:

a container having a top, bottom, sides, a front, and a back, said top having at least one aperture means for receiving a bat, said aperture means extending through said top thereby allowing said bat to be passed into an interior portion of said container, said front of said container being made from means for allowing solar rays to pass through said front and into said interior portion of said container, and wherein said back of said container has a brace attached thereto, said brace being pivotally connected to said back, said brace being movable from a first position where said brace is substantially parallel with said back, to a second position where said brace extends at an angle from said back, and wherein said container has a catch means for holding said brace in said first position, and wherein said catch means comprises;

a pair of supports attached to said back, an aperture in each of said pair of supports, and a rod which passes through said aperture in each of said pair of supports.

2. A bat warmer comprising:

a container having a top, bottom, sides, a front, and a back, said top having at least one aperture means for receiving a bat, said at least one aperture means extending through said top thereby allowing said bat to be passed into an interior portion of said container, said front of said container being made from means for allowing solar rays to pass through said front and into said interior portion of said container, and wherein said bottom has at least one means for receiving said bat after said bat has been passed through said at least one aperture means, and said at least one means for receiving said bat being a depression, said depression being directly aligned with said at least one aperture means, and said depression extending into said bottom, but does not extend through said bottom.

3. The bat warmer as claimed in claim 2, wherein back of said container has a brace attached thereto, said brace being pivotally connected to said back, said brace being movable from a first position where said brace is substantially parallel with said back, to a second position where said brace extends at an angle from said back.

4. The bat warmer as claimed in claim 3, wherein said container has a catch means for holding said brace in said first position.

5. The bat warmer as claimed in claim 3, wherein said brace is attached to said back by a hinge.

6. The bat warmer as claimed in claim 1, wherein said container has a handle means for carrying said container.

7. A bat warmer in combination with a bat, comprising:

a container having a top, bottom, sides, a front, and a back, said top having at least one aperture means for receiving said bat, said at least one aperture means extending through said top, and said bat passing through said at least one aperture means into an interior portion of said container, said front of said container being made from means for allowing solar rays to pass through said front and into said interior portion of said container, and wherein said bottom has at least one means for receiving said bat after said bat has been passed through said at least one aperture means.

* * * * *